US010964260B2

(12) United States Patent
Ota et al.

(10) Patent No.: US 10,964,260 B2
(45) Date of Patent: Mar. 30, 2021

(54) ELECTRO-OPTICAL DEVICE, DRIVING METHOD FOR ELECTRO-OPTICAL DEVICE, AND ELECTRONIC APPARATUS

(71) Applicant: SEIKO EPSON CORPORATION, Tokyo (JP)

(72) Inventors: Hitoshi Ota, Shiojiri (JP); Takeshi Koshihara, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/296,736

(22) Filed: Mar. 8, 2019

(65) Prior Publication Data

US 2019/0279568 A1 Sep. 12, 2019

(30) Foreign Application Priority Data

Mar. 9, 2018 (JP) ..... JP2018-042610

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2300/0861* (2013.01); *G09G 2310/0294* (2013.01); *G09G 2310/0297* (2013.01)

(58) Field of Classification Search
CPC ..... G09G 3/3233; G09G 3/3275; G09G 2310/0297; G09G 2310/0294; G09G 2300/0861; G09G 2320/043; G09G 3/3266; G09G 3/3291; G09G 2310/027
See application file for complete search history.

(56) References Cited

U.S. PATENT DOCUMENTS 5,973,658 A * 10/1999 Kim ..... G02F 1/136204 345/92
2002/0047820 A1* 4/2002 Ha ..... G09G 3/3648 345/87
2002/0118154 A1* 8/2002 Kim ..... G09G 3/3666 345/87
2004/0239603 A1* 12/2004 Toriumi ..... G09G 3/3688 345/89
2004/0252116 A1* 12/2004 Tobita ..... G09G 3/3648 345/211
2005/0024547 A1* 2/2005 Park ..... G09G 3/3688 349/39
2006/0119596 A1* 6/2006 Lin ..... G09G 3/296 345/211

(Continued)

FOREIGN PATENT DOCUMENTS

JP 2004-272103 A 9/2004
JP 2006-309256 A 11/2006

(Continued)

*Primary Examiner* — Jose R Soto Lopez
(74) *Attorney, Agent, or Firm* — Oliff PLC

(57) ABSTRACT

An electro-optical device is provided that includes a first wiring, a first data line and a second data line, a first pixel circuit coupled to the first data line, a second pixel circuit coupled to the second data line, a first switch having a first end coupled to the first wiring and a second end coupled to the first data line, and a second switch having a first end coupled to the first wiring and a second end coupled to the second data line.

11 Claims, 10 Drawing Sheets

(56) References Cited

U.S. PATENT DOCUMENTS

2006/0291309 A1* 12/2006 Maki ..... G09G 3/3688 365/203
2007/0052652 A1* 3/2007 Yoo ..... G09G 3/3688 345/98
2009/0115750 A1* 5/2009 Chen ..... G06F 3/0412 345/204
2012/0169697 A1* 7/2012 Chang ..... G09G 3/3648 345/211
2012/0218316 A1* 8/2012 Wang ..... G09G 3/3688 345/690
2013/0093653 A1* 4/2013 Ota ..... G09G 3/2096 345/77
2013/0093737 A1* 4/2013 Ota ..... G09G 3/3275 345/204
2013/0120341 A1* 5/2013 Kasai ..... G09G 3/3291 345/211
2013/0207564 A1* 8/2013 Ota ..... G09G 3/3291 315/224
2013/0234918 A1* 9/2013 Yamashita ..... G09G 3/3258 345/84
2014/0139510 A1* 5/2014 Han ..... G09G 3/3233 345/212
2014/0184670 A1* 7/2014 Jeong ..... G09G 3/3666 345/694
2014/0285405 A1* 9/2014 Nomura ..... G09G 3/3291 345/55
2015/0015471 A1* 1/2015 Zhu ..... G09G 3/3648 345/92
2015/0049041 A1* 2/2015 Yousefpor ..... G06F 3/0416 345/174
2015/0084946 A1* 3/2015 Shim ..... G09G 3/3258 345/212
2015/0103065 A1* 4/2015 Kim ..... G09G 3/3688 345/212
2015/0243208 A1* 8/2015 Kim ..... G09G 3/3225 345/204
2015/0356925 A1* 12/2015 Lee ..... G09G 3/3233 345/212
2016/0027412 A1* 1/2016 Igawa ..... G09G 3/3648 345/213
2016/0042681 A1* 2/2016 Tamura ..... G09G 3/3208 345/48
2016/0055796 A1 2/2016 Ota et al.
2016/0182901 A1* 6/2016 Lee ..... H04N 13/398 345/691
2016/0267716 A1* 9/2016 Patel ..... G09G 5/373
2016/0322011 A1* 11/2016 Park ..... G09G 3/3685
2017/0125503 A1* 5/2017 Ota ..... H01L 27/3265
2017/0186384 A1* 6/2017 Iwasa ..... G09G 3/3688
2017/0358260 A1* 12/2017 Yumoto ..... G09G 3/3283
2018/0082639 A1* 3/2018 Shin ..... G09G 3/3275
2018/0175129 A1 6/2018 Ota et al.
2018/0182278 A1* 6/2018 Kim ..... G09G 3/2018
2018/0196301 A1* 7/2018 Choi ..... G02F 1/133382
2018/0233077 A1* 8/2018 Fletcher ..... G09G 3/3659
2018/0284510 A1* 10/2018 Um ..... G02F 1/1368
2019/0096304 A1* 3/2019 Hu ..... G09G 3/20
2019/0103060 A1* 4/2019 Kang ..... H01L 51/5206
2019/0130839 A1* 5/2019 Sun ..... G09G 3/3266
2019/0156716 A1* 5/2019 Kim ..... G09G 3/20
2019/0156783 A1* 5/2019 Kim ..... G09G 5/14
2019/0164498 A1* 5/2019 Jang ..... G09G 3/32

FOREIGN PATENT DOCUMENTS

JP 2011-039269 A 2/2011
JP 2013-88611 A 5/2013
JP 2017-083798 A 5/2017

* cited by examiner

ELECTRO-OPTICAL DEVICE, DRIVING METHOD FOR ELECTRO-OPTICAL DEVICE, AND ELECTRONIC APPARATUS

BACKGROUND

1. Technical Field

The invention relates to an electro-optical device, a driving method for the electro-optical device, an electronic apparatus including the electro-optical device, and the like.

2. Related Art

In recent times, various electro-optical devices using a light emitting element such as an organic light emitting diode (hereinafter referred to as an OLED) are proposed. In a known electro-optical device, a pixel circuit including a light emitting element and a drive transistor is provided at an intersection of a scan line and a data line. When a gradation voltage according to a display gradation is applied to a gate of a drive transistor, the drive transistor supplies a current according to a voltage between the gate and a source to the light emitting element. This current causes the light emitting element to emit light at brightness according to the display gradation.

A variation in threshold voltage of the drive transistor causes a variation in current flowing through the light emitting element, which results in a decrease in image quality of a display image. Thus, a variation in threshold voltage of the drive transistor is compensated. JP-A-2013-88611 discloses a technique for short-circuiting a drain and a gate of a drive transistor in a compensation period in which a compensation operation is performed, and setting a value according to a threshold voltage of the drive transistor to a potential of the gate of the drive transistor. This compensation method increases an effect of compensating a variation with a longer compensation period.

However, in the technique disclosed in JP-A-2013-88611, a compensation operation and an operation of writing a gradation voltage are performed within one horizontal scan period. Thus, a gradation voltage cannot be accurately written with a compensation period longer than necessary, and a compensation period having a sufficient length cannot be always secured.

SUMMARY

To solve the problem above, an electro-optical device is provided that includes a first wiring, a first data line and a second data line, a first pixel circuit coupled to the first data line, a second pixel circuit coupled to the second data line, a first switch having a first end coupled to the first wiring and a second end coupled to the first data line, and a second switch having a first end coupled to the first wiring and a second end coupled to the second data line. To solve the problem above, an electro-optical device according to an aspect of the invention includes a first data line and a second data line being divided data lines, a first pixel circuit to the first data line, a second pixel circuit coupled to the second data line, a first capacitor including one electrode coupled to the first data line and the other electrode, a second capacitor including one electrode coupled to the second data line and the other electrode, a first wiring provided with a holding capacitor supplied with a gradation voltage according to a display gradation of the first pixel circuit or a display gradation of the second pixel circuit from a data signal supply circuit, a first switch provided between the other electrode of the first capacitor and the first wiring and configured to be controlled to be in a coupling state or a decoupling state, and a second switch provided between the other electrode of the second capacitor and the first wiring and configured to be controlled to be in a coupling state or a decoupling state. The first pixel circuit includes a first light emitting element, a first drive transistor configured to control a current flowing through the first light emitting element according to a gradation voltage provided from the first data line, and a first compensation circuit. The second pixel circuit includes a second light emitting element, a second drive transistor configured to control a current flowing through the second light emitting element according to a gradation voltage provided from the second data line, and a second compensation circuit.

According to the aspect, the first data line to which the first pixel circuit is coupled is different from the second data line to which the second pixel circuit is coupled, and thus the first pixel circuit and the second pixel circuit can be driven independently. For example, with the first switch in the coupling state, a voltage according to a display gradation of the first pixel circuit is written to the first capacitor via the first wiring. Meanwhile, with the second switch in the decoupling state, the compensation operation of the second drive transistor can be performed by using the second compensation circuit without affecting writing of the gradation voltage to the first capacitor. In other words, according to the aspect, writing of a gradation voltage to one of the first pixel circuit and the second pixel circuit can be performed simultaneously with a compensation operation of the other. Therefore, a compensation operation and an operation of writing a gradation voltage do not need to be completed within one horizontal scan period, and a compensation period can be set over a plurality of horizontal scan periods.

The above-described electro-optical device may include a third switch provided between a reference power source and the other electrode of the first capacitor and configured to be controlled to be in a coupling state or a decoupling state, the reference power source configured to generate a reference potential used in a compensation operation for compensating a threshold voltage of the first drive transistor, a fourth switch provided between the reference power source and the other electrode of the second capacitor and configured to be controlled to be in a coupling state or a decoupling state, a fifth switch provided between an initialization power source and the first data line and configured to be controlled to be in a coupling state or a decoupling state, the initialization power source configured to generate an initialization potential for initializing the first drive transistor or the second drive transistor, and a sixth switch provided between the second data line and the initialization power source and configured to be controlled to be in a coupling state or a decoupling state.

According to the aspect, in the first horizontal scan period, the first switch is fixed in the decoupling state, whereas the third switch is fixed in the coupling state. With the fifth switch in the coupling state, initialization of the first drive transistor is performed. Subsequently, the fifth switch is brought back into the decoupling state, and a compensation operation of a threshold voltage of the first drive transistor can start. Then, in the second horizontal scan period subsequent to the first horizontal scan period, the second switch is fixed in the decoupling state. With the sixth switch in the coupling state, initialization of the second drive transistor is performed. Subsequently, the sixth switch is brought back into the decoupling state, the fourth switch is fixed in the coupling state, and a compensation operation of the second drive transistor can start. In the second horizontal scan period, after the start of the compensation operation of the second drive transistor, the holding capacitor holds a gradation voltage according to a display gradation of the first pixel circuit. After that, with the third switch in the decoupling state and the first switch in the coupling state, a voltage according to the gradation voltage can be written to the first capacitor.

In the above-described electro-optical device, the first wiring may be aligned beside the first data line and the second data line, the electro-optical device may include a second wiring coupled to the first switch and the third switch and aligned beside the first data line, a third wiring coupled to the second switch and the fourth switch and aligned beside the second data line, and a fourth wiring aligned beside the first wiring and provided with a fixed potential, the first data line and the second wiring may form the first capacitor, the second data line and the third wiring may form the second capacitor, and the first wiring and the fourth wiring may form the holding capacitor.

The first capacitor functions as a transfer capacitor for coupling driving of the first pixel circuit. The second capacitor functions as a transfer capacitor for coupling driving of the second pixel circuit. According to the aspect, a circuit area other than a display region in the electro-optical device can be reduced further than that in an aspect where a capacitor functioning as a holding capacitor is coupled to a first wiring.

To solve the problem above, a method of driving the above-described electro-optical device includes, fixing the first switch in a decoupling state, fixing the third switch in a coupling state, setting the fifth switch in a coupling state, performing initialization on the first drive transistor, then bringing the fifth switch back to a decoupling state, and starting a compensation operation of the first drive transistor in a first horizontal scan period, and, fixing the second switch in a decoupling state, setting the sixth switch into a coupling state, performing initialization on the second drive transistor, then bringing the sixth switch back to a decoupling state, fixing the fourth switch in a coupling state, starting a compensation operation of the second drive transistor, causing the holding capacitor to hold a gradation voltage according to a display gradation of the first pixel circuit after the start of the compensation operation of the second drive transistor, then setting the third switch into a decoupling state and the first switch into a coupling state, and writing a voltage according to the gradation voltage to the first capacitor in a second horizontal scan period subsequent to the first horizontal scan period.

Also, in the aspect, a compensation period of the first drive transistor that exceeds one horizontal scan period can be secured, and a compensation period having a sufficient length can be secured.

Further, in addition to the electro-optical device, the invention can be conceived as an electronic apparatus including the electro-optical device. Typical examples of the electronic apparatus include display devices such as a head mounted display (HMD) and an electronic viewfinder.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments for carrying out the invention will be described with reference to accompanying drawings. However, in each drawing, a size and scale of each unit is different from the actual size and scale of each unit as appropriate. In addition, exemplary embodiments described below are desirable specific examples of the invention, and various technically appropriate preferred limitations are applied, but the scope of the invention is not limited to these exemplary embodiments unless a description to the effect that the disclosure is specifically limited is made in the explanation below.

A. Exemplary Embodiment

Figure 1:
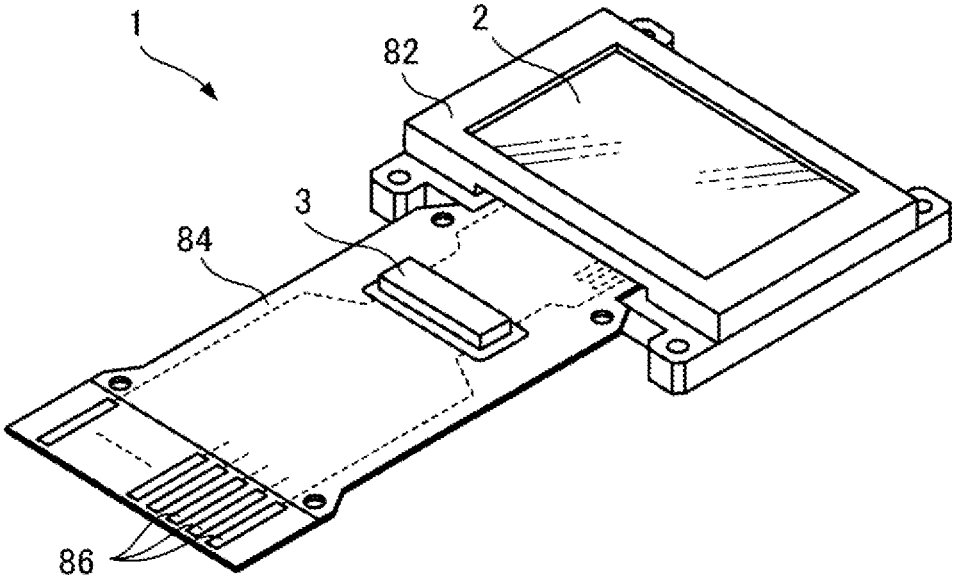
FIG. 1 is a perspective view illustrating a configuration of an electro-optical device according to an exemplary embodiment of the invention.

FIG. 1 is a perspective view illustrating a configuration of an electro-optical device 1 according to an exemplary embodiment of the invention. The electro-optical device 1 is a micro display configured to display an image in a head-mounted display, for example.

As illustrated in FIG. 1, the electro-optical device 1 includes a display panel 2 and a control circuit 3 configured to control the operation of the display panel 2. The display panel 2 includes a plurality of pixel circuits, and a drive circuit for driving the pixel circuits. In the exemplary embodiment, the plurality of pixel circuits and the drive circuit of the display panel 2 are formed in a silicon substrate, and an OLED, which is an example of an electro-optical element, is used in the pixel circuits. Further, for example, the display panel 2 is housed in a frame-shaped case 82 opened at the display unit, while being coupled with one end of a Flexible Printed Circuits (FPC) substrate 84. The control circuit 3 of a semiconductor chip is mounted on the FPC substrate 84 by Chip On Film (COF) method, wherein a plurality of terminals 86 are disposed to be coupled to an upper circuit (not illustrated).

Figure 2:
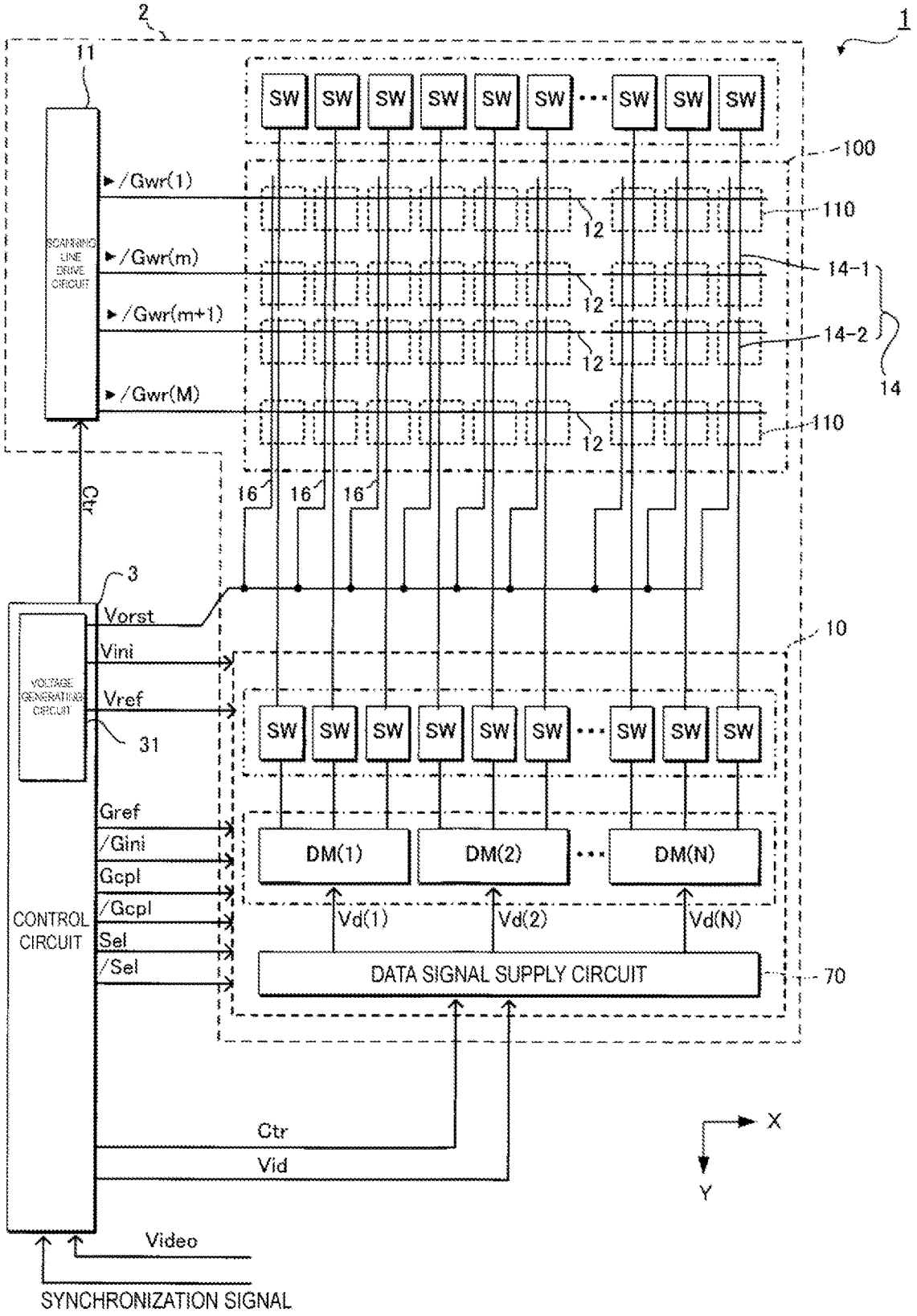
FIG. 2 is a diagram illustrating an electrical configuration of the electro-optical device.

FIG. 2 is a block diagram illustrating a configuration of the electro-optical device 1 according to the exemplary embodiment. As described above, the electro-optical device 1 includes the display panel 2 and the control circuit 3.

To the control circuit 3, digital image data Video is supplied from the upper circuit (not illustrated) synchronously with a synchronizing signal. Here, the image data Video is data defining a display gradation of pixels of an image to be displayed on the display panel 2 (strictly speaking, a display unit 100 described later), for example, with 8 bits. Further, the synchronization signal is a signal including vertical synchronization signal, horizontal synchronization signal, and dot clock signal.

The control circuit 3 generates various control signals on the basis of the synchronization signal, and supplies the generated control signals to the display panel 2. Specifically, the control circuit 3 supplies a control signal Ctr, positive logic control signals GrefU and GrefD, and negative logic control signals /GiniU and /GiniD to the display panel 2. Furthermore, to the display panel 2, the control circuit 3 supplies a positive logic control signal GcplU, a negative logic control signal /GcplU having a logic inverted relationship with the control signal GcplU, a positive logic control signal GcplD, a negative logic control signal /GcplD having a logic inverted relationship with the control signal GcplD, control signals Sel(1), Sel(2) and Sel(3), and control signals /Sel(1), /Sel(2) and /Sel(3) having respective logic inverted relationships with the control signals Sel(1), Sel(2) and Sel(3).

Here, the control signal Ctr is a signal including a plurality of signals such as a pulse signal, a clock signal, and an enable signal.

Note that the control signals Sel(1), Sel(2) and Sel(3) are generally called the control signal Sel, and the control signals /Sel(1), /Sel(2) and /Sel(3) are generally called the control signal /Sel. Similarly, the control signals GrefU and GrefD are generally called the control signal Gref, the control signals /GiniU and /GiniD are generally called the control signal /Gini, the control signals GcplU and GcplD are generally called the control signal Gcpl, and the control signals /GcplU and/GcplD are generally called the control signal /Gcpl. The control circuit 3 further includes a voltage generating circuit 31. The voltage generating circuit 31 supplies various potentials to the display panel 2. Specifically, the control circuit 3 supplies a reset potential Vorst, a reference potential Vref, and an initialization potential Vini to the display panel 2.

Further, the control circuit 3 generates an analog image signal Vid based on the image data Video. Specifically, the control circuit 3 is provided with a look-up table in which the potential indicated by the image signal Vid and brightness of a light emitting element (OLED 130 described below) included in the display panel 2 are stored in association with each other. Then, the control circuit 3 generates the image signal Vid indicating the potential corresponding to the brightness of the light emitting element defined by the image data Video with reference to the lookup table, and supplies the image signal Vid to the display panel 2.

As illustrated in FIG. 2, the display panel 2 includes the display unit 100, and a drive circuit (a data line drive circuit 10 and a scan line drive circuit 11) configured to drive the display unit 100.

In the display unit 100, pixel circuits 110 corresponding to pixels of an image to be displayed are arranged in a matrix. Specifically, scan lines 12 of M rows extend in a horizontal direction (X direction) in the drawing in the display unit 100. Data lines 14 of (3N) columns grouped by each three columns are provided while maintaining mutual electrical insulation with each of the scan lines 12. As illustrated in FIG. 2, each of the data lines 14 of (3N) columns is vertically divided in two as a first data line 14-1 and a second data line 14-2. The first data line 14-1 extends in a vertical direction (Y direction) across a first scan line 12 to an m-th ($1<m<M$) scan line 12 from the top in Y direction in the display unit 100. The second data line 14-2 extends in the vertical direction (Y direction) across an (m+1)-th scan line 12 to an M-th scan line 12 from the top in the display unit 100. Here, M and N are both natural numbers. For example, when M=1080, m=540.

The pixel circuit 110 is provided to correspond to each of the first scan line 12 to the m-th scan line 12 from the top and each of the first data lines 14-1 of (3N) columns. The pixel circuit 110 is provided to correspond to each of the (m+1)-th scan line 12 to the M-th scan line 12 and each of the second data lines 14-2 of (3N) columns. Thus, in the exemplary embodiment, the pixel circuits 110 are arranged in a matrix with M rows vertically and (3N) columns horizontally.

In order to distinguish the rows of the scan lines 12 and the matrix of the pixel circuits 110, the rows may be sequentially referred to as 1, 2, 3, . . . , and (M−1), and M row from the top in the diagram. Similarly, in order to distinguish the columns of the first data line 14-1, the second data line 14-2 and the matrix of the pixel circuits 110, the columns may be sequentially referred to as 1, 2, 3, . . . , (3N−1), and (3N) column from the left in the diagram.

Here, when an integer greater than or equal to 1 is represented by n in order to generalize and describe a group of the data lines 14, the data lines 14 of a (3n−2)-th column, a (3n−1)-th column, and a (3n)-th column belong to an n-th group counting from the left. In other words, the first data lines 14-1 of the (3n−2)-th column, the (3n−1)-th column, and the (3n)-th column and the second data lines 14-2 of the (3n−2)-th column, the (3n−1)-th column, and the (3n)-th column belong to the n-th group.

Hereinafter, a group of the 3N×m pixel circuits 110 provided to correspond to each of the scan lines 12 of the first to the m-th row and each of the first data lines 14-1 of (3N) columns is referred to as an "upper pixel block". A group of the 3N×m pixel circuits 110 provided to correspond to each of the scan lines 12 of the (m+1)-th to the M-th row and each of the second data lines 14-2 of (3N) columns is referred to as a "lower pixel block".

The three pixel circuits 110 corresponding to the scan line 12 of the same row and three columns of the first data lines 14-1 belonging to the same group respectively correspond to R (red), G (green), and B (blue) pixels, and these three pixels represent one dot of a color image to be displayed. Similarly, the three pixel circuits 110 corresponding to the scan line 12 of the same row and three columns of the second data lines 14-2 belonging to the same group respectively correspond to R (red), G (green), and B (blue) pixels, and these three pixels represent one dot of a color image to be displayed. That is, in the exemplary embodiment, the color of one dot is configured to be represented by additive color mixture by light emission of the OLED corresponding to RGB.

Further, as illustrated in FIG. 2, in the display unit 100, feed lines (reset potential supply lines) 16 of (3N) columns are provided extending in the vertical direction, and maintain mutual electrical insulation with the scan lines 12. A predetermined reset potential Vorst is supplied in common to each of the feed lines 16. Here, in order to distinguish the columns of the feed lines 16 from each other, the columns may be sequentially referred to as 1, 2, 3, . . . , and (3N) column from the left in the diagram. The feed lines 16 in the first to (3N)-th columns are provided correspondingly to the data lines 14 in the first to (3N)-th columns respectively.

Figure 3:
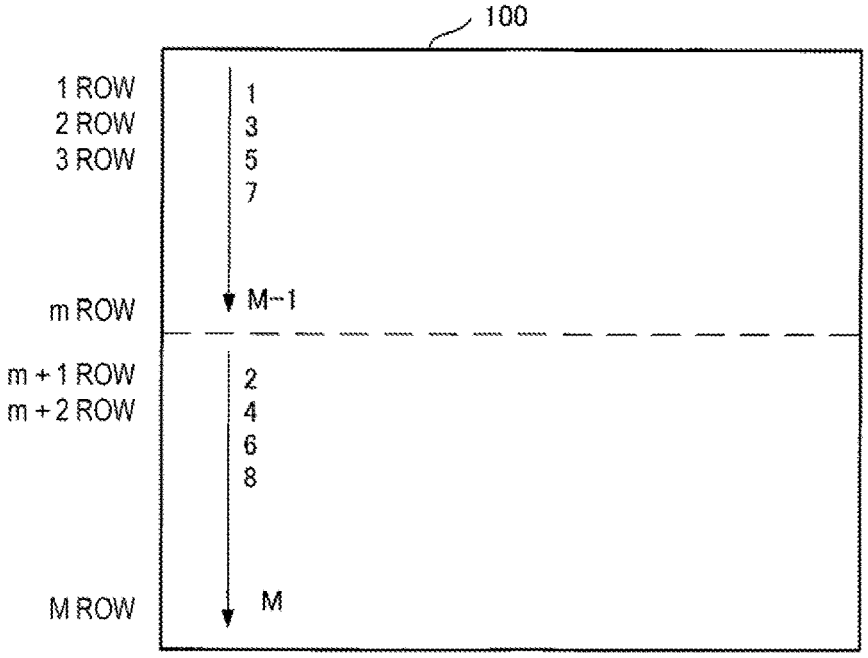
FIG. 3 is a diagram illustrating an order of row scanning by a scan line drive circuit in the electro-optical device.

The scan line drive circuit 11 generates negative logic scan signals /Gwr for selecting M scan lines 12 in a single frame period sequentially row by row, in accordance with the control signal Ctr. Here, the scan signals /Gwr supplied to the scan lines 12 in 1, 2, 3, . . . , and M-th row are respectively denoted by /Gwr(1), /Gwr(2), /Gwr(3), . . . , /Gwr(M−1), and /Gwr(M). Note that the scan line drive circuit 11, in addition to the scan signals /Gwr(1) to /Gwr (M), generates various types of control signals synchronized with the scan signals /Gwr for each row, and supplies these signals to the display unit 100; however, such illustration is omitted in FIG. 2. The frame period refers to a period necessary for the electro-optical device 1 to display one cut (frame) of an image. For example, when the frequency of the vertical synchronization signal included in the synchronization signal is 120 Hz, the period is 8.3 milliseconds of one cycle. FIG. 3 is a diagram illustrating an order of row selection in a single frame period. As illustrated in FIG. 3, the scan line drive circuit 11 selects each one of the M scan lines 12 in the order of the scan line 12 in the first row, the scan line 12 in the (m+1)-th row, the scan line 12 in the second row, the scan line 12 in the (m+2)-th row, . . . the scan line 12 in the (m−1)-th row, the scan line 12 in the (M−1)-th row, the scan line 12 in the m-th row, and the scan line 12 in the M-th row in a single frame period.

The data line drive circuit 10 includes a switch unit SW (namely, a switch unit SW provided for the first data line 14-1 and a switch unit SW provided for the second data line 14-2) vertically provided for each of the data lines 14 of (3N) columns, N demultiplexers DM provided for each of the data lines 14 of the three columns constituting each group, and a data signal supply circuit 70. Although it is omitted from FIG. 2, the switch unit SW provided on the upper side is supplied with various control signals, the reference potential Vref, and the initialization potential Vini from the control circuit 3, similarly to the switch unit SW on the lower side.

Hereinafter, the switch unit SW provided for the first data line 14-1 is referred to as SW-1, and the switch unit SW provided for the second data line 14-2 is referred to as SW-2. Hereinafter, the switch unit SW provided for the first data line 14-1 in the (3n−2)-th column is referred to as SW-1 (3n−2), and the switch unit SW provided for the second data line 14-2 in the (3n−2)-th column is referred to as SW-2 (3n−2). Similarly, the switch unit SW provided for the first data line 14-1 in the (3n−1)-th column is referred to as SW-1(3n−1), and the switch unit SW provided for the second data line 14-2 in the (3n−1)-th column is referred to as SW-2(3n−1). Similarly, the switch unit SW provided for the first data line 14-1 in the (3n)-th column is referred to as SW-1(3n), and the switch unit SW provided for the second data line 14-2 in the (3n)-th column is referred to as SW-2(3n).

The data signal supply circuit 70 includes an amplifier that generates data signals Vd(1), Vd(2), . . . , and Vd(N) for each column on the basis of the image signal Vid and the control signal Ctr supplied from the control circuit 3. The data signal supply circuit 70 generates data signals Vd(1), Vd(2), . . . , and Vd(N) on the basis of the image signal Vid obtained by time division multiplexing the data signals Vd(1), Vd(2), . . . , and Vd(N). Then, the data signal supply circuit 70 respectively supplies the data signals Vd(1), Vd(2), . . . , and Vd(N) to the demultiplexers DM corresponding to 1, 2, . . . , and N-th groups.

Figure 4:
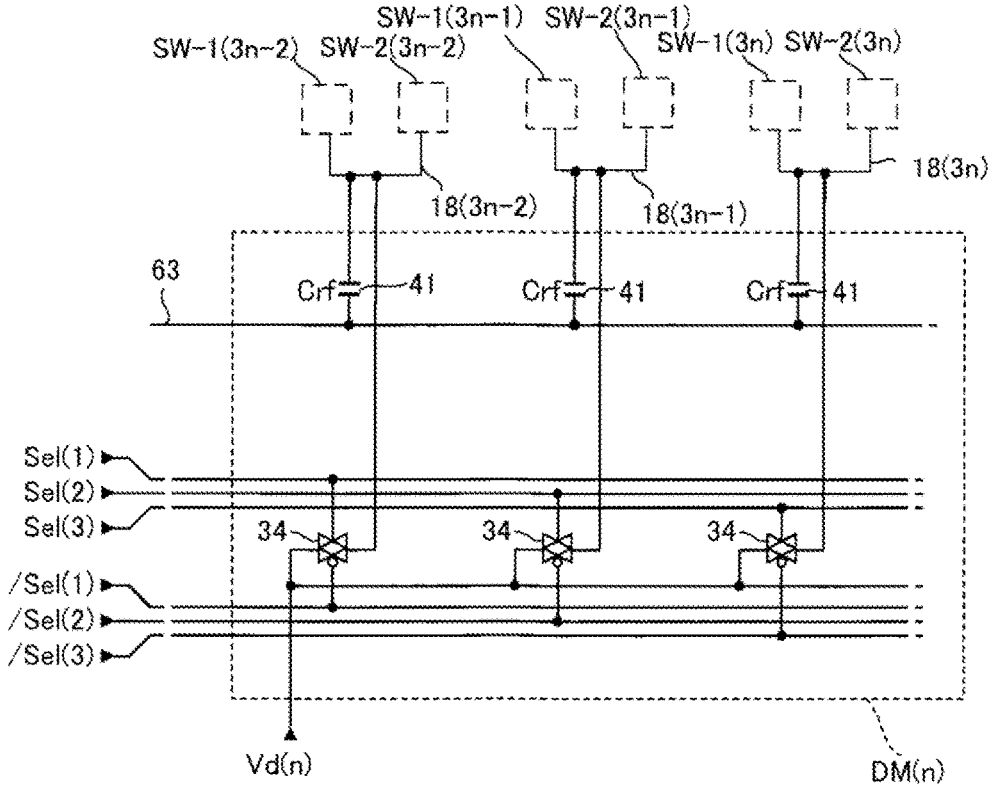
FIG. 4 is a circuit diagram for illustrating a configuration of a demultiplexer in the electro-optical device.

Hereinafter, a configuration of the demultiplexer DM, the switch unit SW, and the pixel circuit 110 is described with reference to FIGS. 4 and 5. FIG. 4 is a circuit diagram for illustrating a configuration of the demultiplexer DM. Note that, FIG. 4 illustrates the demultiplexer DM belonging to the n-th group as a representative. Note that, the demultiplexer DM belonging to the n-th group is represented by DM(n).

As illustrated in FIG. 4, the demultiplexer DM includes a capacitor 41 provided in each column similarly to a transmission gate 34 provided in each column, and supplies data signals in order to the three columns constituting each group. Here, the input ends of the transmission gates 34 corresponding to (3n−2), (3n−1), and 3(n) columns belonging to the n-th group are mutually coupled in common and respective data signals Vd(n) are supplied to the common terminals. The transmission gate 34 provided in (3n−2) column at the left end column in the n-th group is turned ON (conducts) when the control signal Sel(1) is an H level (when the control signal /Sel(1) is the L level). Similarly, the transmission gate 34 provided in (3n−1) column in the center column in the n-th group is turned ON when the control signal Sel(2) is the H level (when the control signal /Sel(2) is the L level), and the transmission gate 34 provided in (3n) column at the right end column in the n-th group is turned ON when the control signal Sel(3) is the H level (when the control signal /Sel(3) is the L level).

As illustrated in FIG. 4, the output end of the transmission gate 34 provided in (3n−2) column is coupled to a signal line 18(3n−2) that connects the switch unit SW-1(3n−2) to the switch unit SW-2(3n−2). Similarly, the output end of the transmission gate 34 provided in (3n−1) column is coupled to the signal line 18(3n−1) that connects the switch unit SW-1(3n−1) to the switch unit SW-2(3n−1). The output end of the transmission gate 34 provided in (3n) column is coupled to the signal line 18(3n) that connects the switch unit SW-1(3n) to the switch unit SW-2(3n). Note that, hereinafter, when the signal line 18(3n), the signal line 18(3n−1), and the signal line 18(3n−2) do not need to be distinguished from one another, they are represented by the "signal line 18". One electrode of the capacitor 41 provided in (3n) column is coupled to the signal line 18(3n). Similarly, one electrode of the capacitor 41 provided in (3n−1) column is coupled to the signal line 18(3n−1). One electrode of the capacitor 41 provided in (3n−2) column is coupled to the signal line 18(3n−2).

When the transmission gate 34 in (3n) column is turned on, the data signal Vd(n) is supplied to the signal line 18(3n) via the output end of the transmission gate 34 in (3n) column. Similarly, when the transmission gate 34 in (3n−1) column is turned on, the data signal Vd(n) is supplied to the signal line 18(3n−1) via the output end of the transmission gate 34 in (3n−1) column. When the transmission gate 34 in (3n−2) column is turned on, the data signal Vd(n) is supplied to the signal line 18(3n−2) via the output end of the transmission gate 34 in (3n−2) column. That is, the data signal Vd(n) is supplied to one electrode of the capacitor 41 in each column. The other electrode of the capacitor 41 in each column is commonly coupled to a feed line 63 to which a potential Vss as a fixed potential is supplied. Here, the potential Vss may be equivalent to the L level of the scan signal and the control signal, which are logic signals.

Next, a configuration of the switch unit SW-1 and the switch unit SW-2 is described with reference to FIG. 5. FIG. 5 illustrates a configuration example of the switch unit SW-1 and the switch unit SW-2 belonging to the (3n−2)-th column at the left end column in the n-th group. FIG. 5 illustrates the feed line 16, the first data line 14-1, the second data line 14-2, the signal line 18, a signal line 20-1, a signal line 20-2, a capacitor 50-1*a* capacitor 50-2, the transmission gate 34 that outputs the data signal Vd(n) to the signal line 18, and the capacitor 41 coupled to the signal line 18, which belong to the (3n−2)-th column. As illustrated in FIG. 5, the switch unit SW-1 includes an N-channel MOS type transistor 45-1, a P-channel MOS type transistor 126-1, and a transmission gate 42-1. Similarly, the switch unit SW-2 includes an N-channel MOS type transistor 45-2, a P-channel MOS type transistor 126-2, and a transmission gate 42-2.

The signal line 20-1 is coupled to the output end of the transmission gate 42-1. The signal line 20-2 is coupled to the output end of the transmission gate 42-2. The input end of the transmission gate 42-1 and the input end of the transmission gate 42-2 are coupled to each other via the signal line 18. The signal line 18 is coupled to the output end of the transmission gate 34 in the corresponding column. As illustrated in FIG. 5, the signal line 20-1 is coupled to one electrode of the capacitor 50-1 (first capacitor), and the other electrode of the capacitor 50-1 is coupled to the first data line 14-1. Similarly, the signal line 20-2 is coupled to one electrode of the capacitor 50-2 (second capacitor), and the other electrode of the capacitor 50-2 is coupled to the second data line 14-2.

Hereinafter, the signal line 18, the signal line 20-1, the signal line 20-2, and the feed line 16 are respectively referred to as a "first wiring", a "second wiring", a "third wiring", and a "fourth wiring". The control signal /GcplU is supplied from the control circuit 3 to a gate of the transmission gate 42-1. The transmission gate 42-1 is a first switch that brings the signal line 20-1 and the signal line 18 into an electrical coupling state when the control signal /GcplU is the L level, and brings the signal line 20-1 and the signal line 18 into a non-electrical coupling state (decoupling state) when the control signal /GcplU is the H level. The control signal /GcplD is supplied from the control circuit 3 to a gate of the transmission gate 42-2. The transmission gate 42-2 is a second switch that brings the signal line 20-2 and the signal line 18 into an electrical coupling state when the control signal /GcplD is the L level, and brings the signal line 20-2 and the signal line 18 into a non-electrical coupling state when the control signal /GcplD is the H level.

One of a source and a drain of the transistor 45-1 is coupled to the signal line 20-1, and the other is coupled to the feed line 16. Similarly, one of a source and a drain of the transistor 45-2 is coupled to the signal line 20-2, and the other is coupled to the feed line 16. The feed line 16 is coupled to a reference power source (voltage generating circuit 31 in FIG. 2 in the exemplary embodiment) that generates the reference potential Vref used in a compensation operation of a threshold voltage of the drive transistor included in the pixel circuit 110. The reference potential Vref is applied to the feed line 16. The control circuit 3 supplies the control signal GrefU to the transistor 45-1 in each column, and supplies the control signal GrefD to the transistor 45-2 in each column. The transistor 45-1 is a third switch that brings the signal line 20-1 and the feed line 16 into an electrical coupling state when the control signal GrefU is the H level, and brings the signal line 20-1 and the feed line 16 into a non-electrical coupling state when the control signal GrefU is the L level. The transistor 45-2 is a fourth switch that brings the signal line 20-2 and the feed line 16 into an electrical coupling state when the control signal GrefD is the H level, and brings the signal line 20-2 and the feed line 16 into a non-electrical coupling state when the control signal GrefD is the L level.

One of a source and a drain of the transistor 126-1 is coupled to the first data line 14-1, and the other of the source and the drain of the transistor 126-1 is coupled to an initialization power source (voltage generating circuit 31 in FIG. 2 in the exemplary embodiment) that supplies the initialization potential Vini. The control signal /GiniU is provided from the control circuit 3 to a gate of the transistor 126-1. The transistor 126-1 is a fifth switch that brings the first data line 14-1 and the initialization power source into an electrical coupling state when the control signal /GiniU is the L level, and brings the first data line 14-1 and the initialization power source into a non-electrical coupling state when the control signal /GiniU is the H level. One of a source and a drain of the transistor 126-2 is coupled to the second data line 14-2, and the other of the source and the drain of the transistor 126-2 is coupled to the initialization power source. The control signal /GiniD is provided from the control circuit 3 to a gate of the transistor 126-2. The transistor 126-2 is a sixth switch that brings the second data line 14-2 and the initialization power source into an electrical coupling state when the control signal /GiniD is the L level, and brings the first data line 14-2 and the initialization power source into a non-electrical coupling state when the control signal /GiniD is the H level.

Figure 5:
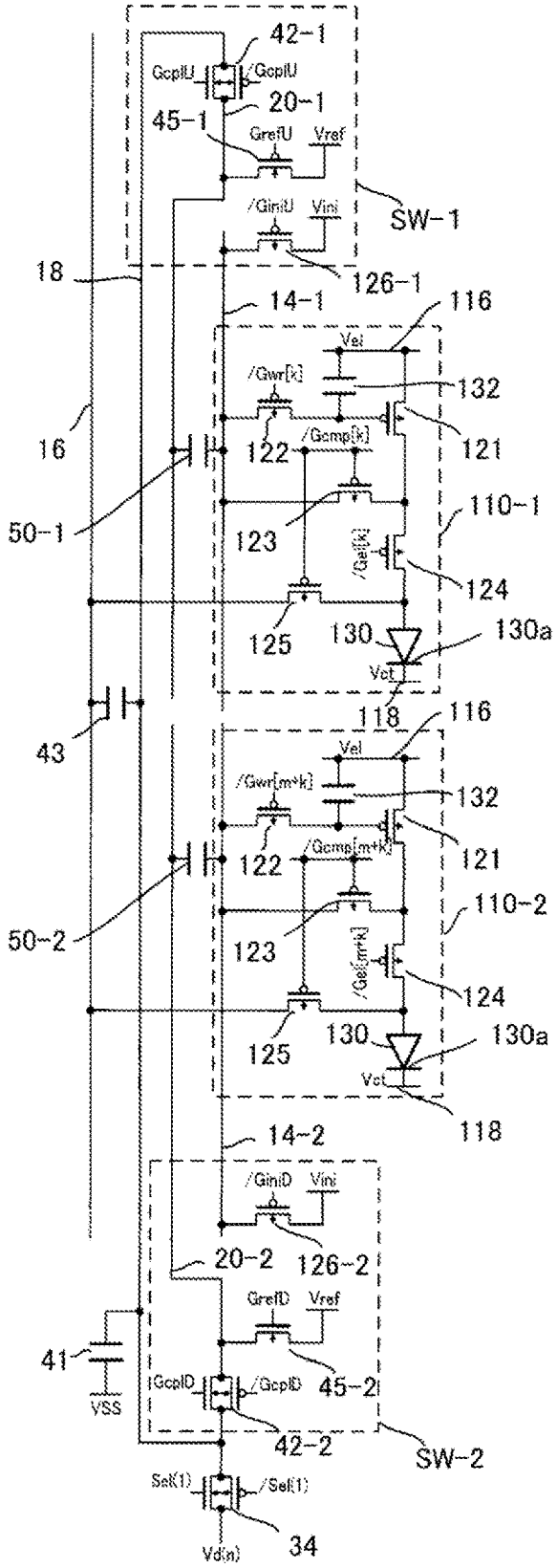
FIG. 5 is a circuit diagram illustrating a configuration of a pixel circuit and a switch unit in the electro-optical device.

As illustrated in FIG. 5, the switch unit SW-1 is disposed on the upper side (opposite side from the direction in which the data signal supply circuit 70 is disposed when seen from the display unit 100) of the display unit 100. The signal line 18 extends in the column direction in the display region of the display unit 100. The feed line 16 extends along the signal line 18. Thus, an inter-wiring capacitor 43 generated between the signal line 18 and the feed line 16 (see FIG. 5). This inter-wiring capacitor 43 functions as a holding capacitor that holds an electric charge according to the data signal Vd(n) together with the capacitor 41. In the exemplary embodiment, as illustrated in FIG. 5, the signal line 20-1 is provided along the first data line 14-1 in the display region of the display unit 100, and the inter-wiring capacitor is also generated between the signal line 20-1 and the first data line 14-1. Thus, the inter-wiring capacitor between the signal line 20-1 and the first data line 14-1 may function as the capacitor 50-1. Similarly, as illustrated in FIG. 5, the signal line 20-2 is also provided along the second data line 14-2 in the display region of the display unit 100. The inter-wiring capacitor is also generated between the signal line 20-2 and the second data line 14-2. Thus, the inter-wiring capacitor between the signal line 20-2 and the second data line 14-2 may function as the capacitor 50-2.

The pixel circuit 110 will be described with reference to FIG. 5.

FIG. 5 illustrates a configuration example of the pixel circuit 110 in k-th row and (3n−2)-th column located in the k-th row (k=1 to m) and located in the (3n−2)-th column at the left end column in the n-th group, and the pixel circuit 110 in (m+k)-th row and (3n−2)-th column. Hereinafter, the pixel circuit 110 in the k-th row and the (3n−2)-th column is referred to as a "first pixel circuit 110-1", and the pixel circuit 110 in the (m+k)-th row and the (3n−2)-th column is referred to as a "second pixel circuit 110-2". The first pixel circuit 110-1 is one example of the pixel circuit 110 belonging to the upper pixel block. The second pixel circuit 110-2 is one example of the pixel circuit 110 belonging to the lower pixel block and belonging to the same column as that of the first pixel circuit 110-1. As illustrated in FIG. 5, the first pixel circuit 110-1 and the second pixel circuit 110-2 have the same electrical configuration, and thus the first pixel circuit 110-1 will be described below as an example.

As illustrated in FIG. 5, the first pixel circuit 110-1 is coupled to the first data line 14-1. A gradation voltage according to designated gradation is supplied to the first pixel circuit 110-1 via the signal line 20-1, the capacitor 50-1, and the first data line 14-1.

The first pixel circuit 110-1 includes P-channel MOS type transistors 121 to 125, an OLED 130, and a pixel capacitor 132. The scan signal /Gwr(k) and the control signals /Gcmp(k) and /Gel(k) are supplied from the scan line drive circuit 11 to the first pixel circuit 110-1 in the k-th row.

A gate of the transistor 122 is electrically coupled to the scan line 12 in the k-th row, and one of a source and a drain of the transistor 122 is electrically coupled to the first data line 14-1. Further, the other of the source and the drain of the transistor 122 is electrically coupled to a gate of the transistor 121 and one electrode of the pixel capacitor 132. In other words, the transistor 122 is electrically coupled between the gate of the transistor 121 and the first data line 14-1. Then, the transistor 122 functions as a switch configured to control the electrical coupling between the gate of the transistor 121 and the first data line 14-1 in the (3n−2)-th column.

A source of the transistor 121 is electrically coupled to a feed line 116. A drain of the transistor 121 is electrically coupled to one of a source and a drain of the transistor 123 and a source of the transistor 124. Here, a potential Vel which is the high-order side of the power source in the first pixel circuit 110-1 is supplied to the feed line 116. The transistor 121 functions as a drive transistor in which a current corresponding to the voltage between the gate and the source of the transistor 121 flows to the OLED 130. Hereinafter, the transistor 121 of the first pixel circuit 110-1 is referred to as a "first drive transistor", and the transistor 121 of the second pixel circuit 110-2 is referred to as a "second drive transistor".

The other of the source and the drain of the transistor 123 is coupled to the first data line 14-1. The control signal /Gcmp(k) is provided to a gate of the transistor 123.

The transistor 122 is coupled between one of the source and the drain of the transistor 123 and the gate of the transistor 121, but it may also be understood that one of the source and the drain of the transistor 123 is electrically coupled to the gate of the transistor 121. The transistor 123 is a transistor for making conduction between the gate and the drain of the transistor 121 via the transistor 122. The transistor 123 in the first pixel circuit 110-1 functions as a first compensation circuit configured to control the electrical coupling between the gate and the drain of the first drive transistor during a compensation operation of compensating a threshold voltage of the first drive transistor. Similarly, the transistor 123 in the second pixel circuit 110-2 functions as a second compensation circuit configured to control the electrical coupling between the gate and the drain of the second drive transistor during a compensation operation of compensating a threshold voltage of the second drive transistor.

The control signal /Gel(k) is provided to a gate of the transistor 124. A drain of the transistor 124 is electrically coupled to a source of the transistor 125 and an anode 130*a* of the OLED 130. The transistor 124 functions as a switching transistor configured to control the electrical coupling between the drain of the transistor 121 and the anode 130*a* of the OLED 130. Furthermore, the transistor 124 is coupled between the drain of the transistor 121 and the anode 130*a* of the OLED 130, but it may also be understood that the drain of the transistor 121 is electrically coupled to the anode 130*a* of the OLED 130.

The control signal /Gcmp(k) is provided to a gate of the transistor 125. A drain of the transistor 125 is electrically coupled to the feed line 16 in the (3n−2)-th column and maintained at the reset potential Vorst. The transistor 125 functions as a switching transistor configured to control the electrical coupling between the feed line 16 and the anode 130*a* of the OLED 130.

Note that, in the exemplary embodiment, the display panel 2 is formed in a silicon substrate, and therefore a substrate potential of the transistors 121 to 126 is the potential Vel. Further, the sources and the drains of the transistors 121 to 125, 126-1 and 126-2 in the above may switch in accordance with the channel type and potential relationship of the transistors 121 to 125, 126-1, and 126-2. Further, the transistor may be a thin film transistor or a field effect transistor.

In the pixel capacitor 132, one of the two electrodes is electrically coupled to the gate of the transistor 121, and the other is electrically coupled to the feed line 116. Thus, the pixel capacitor 132 holds the voltage between the gate and the source of the transistor 121. A gradation voltage held in the holding capacitor is written to the pixel capacitor 132 of the first pixel circuit 110-1 in the k-th row via the transistor 122, the first data line 14-1, the capacitor 50-1, and the signal line 20-1 during writing in the k-th row. Here, as the pixel capacitor 132, a capacitor which is parasitic to the gate of the transistor 121 may be used, and a capacitor formed by interposing an insulating layer with mutually different conductive layers in a silicon substrate may be used.

The anode 130*a* of the OLED 130 is a pixel electrode provided individually for each pixel circuit 110. In contrast, a cathode of the OLED 130 is a common electrode 118 commonly provided across all of the pixel circuits 110, and is maintained at a potential Vct being a low-order side of the power source in the pixel circuit 110. The OLED 130 is an element in which a white organic electroluminescent (EL) layer is interposed between the anode 130*a* and the cathode having light transmission, in the above-described silicon substrate. Then, a color filter corresponding to any one of RGB is superimposed on the emission side (cathode side) of the OLED 130. Note that the optical distance between the two reflection layers disposed interposing the white organic EL layer may be adjusted to form a cavity structure, and the wavelength of the light emitted from the OLED 130 may be set. In this case, a color filter may or may not be provided.

When a current flows from the anode 130*a* to the cathode in the OLED 130, holes injected from the anode 130*a* and electrons injected from the cathode are recombined in the organic EL layer to generate excitons and generate white light. A configuration is adopted in which the white light generated at this time is transmitted through the cathode opposite to the silicon substrate (anode 130*a*), colored using the color filter, and made visible on the observer side. Hereinafter, the OLED 130 of the first pixel circuit 110-1 is referred to as a "first light emitting element", and the OLED 130 of the second pixel circuit 110-2 is referred to as a "second light emitting element".

The configuration of the electro-optical device 1 is described above.

Next, an operation of the electro-optical device 1 will be described with reference to FIGS. 6 to 10 by taking the first pixel circuit 110-1 and the second pixel circuit 110-2 as an example.

Figure 6:
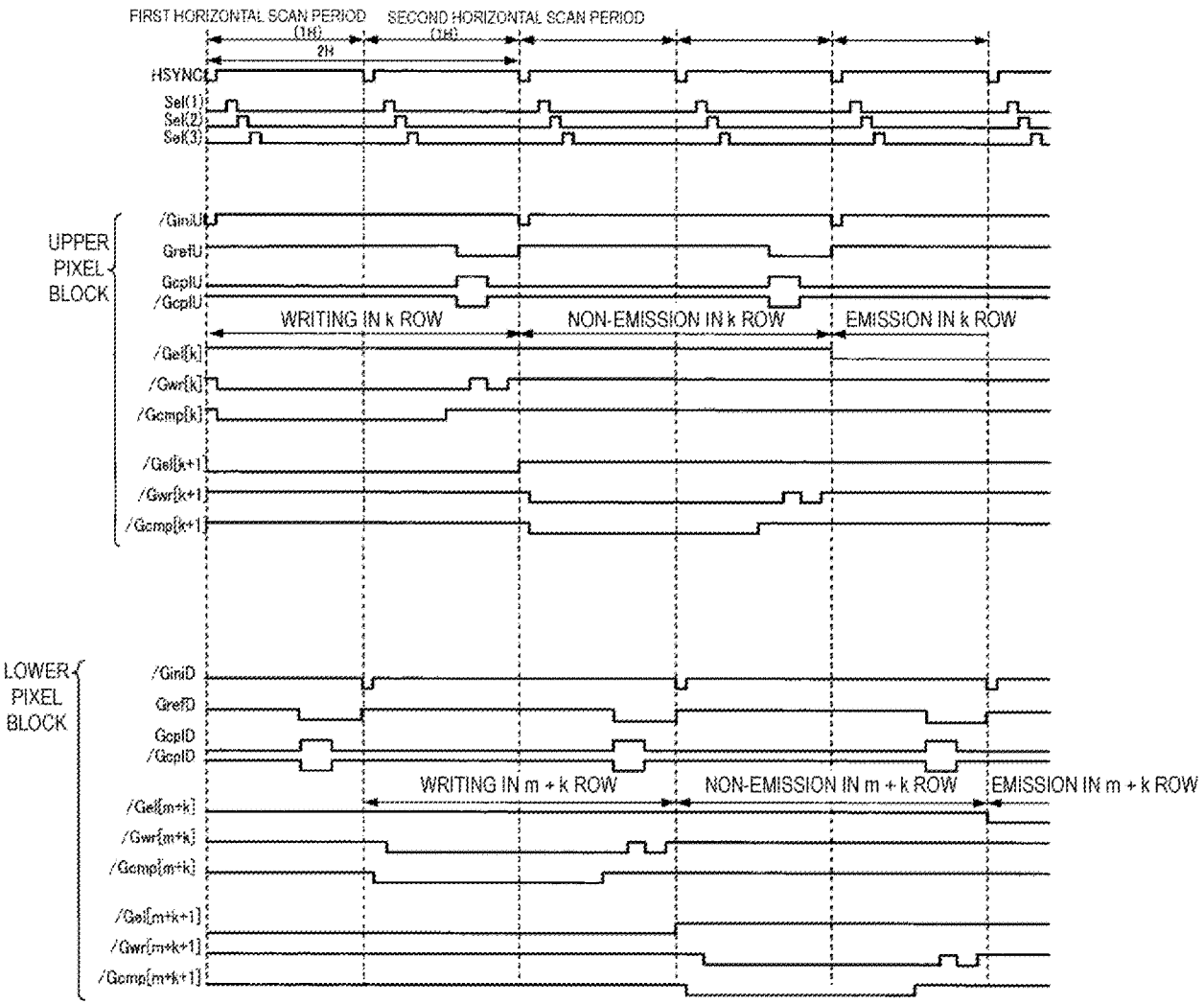
FIG. 6 is a timing chart illustrating an operation of the electro-optical device.

FIG. 6 is a timing chart for illustrating an operation of each unit of the electro-optical device 1. In the electro-optical device 1, scanning of the scan line 12 starts every time a horizontal synchronization signal HSYNC falls, that is, every horizontal scan period (represented by 1H in FIG. 6), and initialization of the pixel circuit 110 provided to correspond to the scan line 12 starts. FIG. 6 illustrates a state of an operation of each unit of the scan line 12 in the k (1≤k<m)-th row, the scan line 12 in the (k+m)-th row, the scan line 12 in the (k+1)-th row, and the scan line 12 in (m+k+1)-th row in the electro-optical device 1 in the horizontal scan period. As illustrated in FIG. 3, the scan line 12 in the (m+k)-th row is scanned after the scan line 12 in the k-th row in the exemplary embodiment, the scan line 12 in the (k+1)-th row is operated after the scan line 12 in the (m+k)-th row, and the scan line 12 in the (m+k+1)-th row is scanned after the scan line 12 in the (k+1)-th row. Hereinafter, the horizontal scan period of the scan line 12 in the k-th row is referred to as a "first horizontal scan period", and the horizontal scan period subsequent to the first horizontal scan period, namely, the horizontal scan period of the scan line 12 in the (m+k)-th row is referred to as a "second horizontal scan period".

As illustrated in FIG. 6, when the first horizontal scan period starts, the control circuit 3 fixes the control signals /GcplU, /Gel(k) and GrefU at the H level. The control circuit 3 also shifts the control signal /GiniU to the L level upon the start of the first horizontal scan period, and brings the control signal /GiniU back to the H level after maintaining the control signal /GiniU at the L level for a certain period of time (see FIG. 6). Then, after the lapse of the certain period of time, the control circuit 3 shifts the scan signal /Gwr(k) and the control signal /Gcmp(k) to the L level, and maintains the scan signal /Gwr(k) and the control signal /Gcmp(k) in this state for the first horizontal scan period.

Since the control signal /Gel(k) is the H level in the first horizontal scan period, the transistor 124 in each of 3N pixel circuits 110 belonging to the k-th row is turned OFF, and the OLED 130 (first light emitting element) included in the pixel circuit 110 is set in a non-emission state. Since the control signals /GcplU and GrefU are fixed at the H level during the first horizontal scan period, the transmission gate 42-1 (first switch) is fixed in a decoupling state, and the transistor 45-1 (third switch) is fixed in a coupling state. Thus, during the first horizontal scan period, the scan line 20-1 is electrically decoupled from the signal line 18, and the potential of the signal line 20-1 is fixed at the reference potential Vref (FIGS. 7 and 8: U11).

Figure 7:
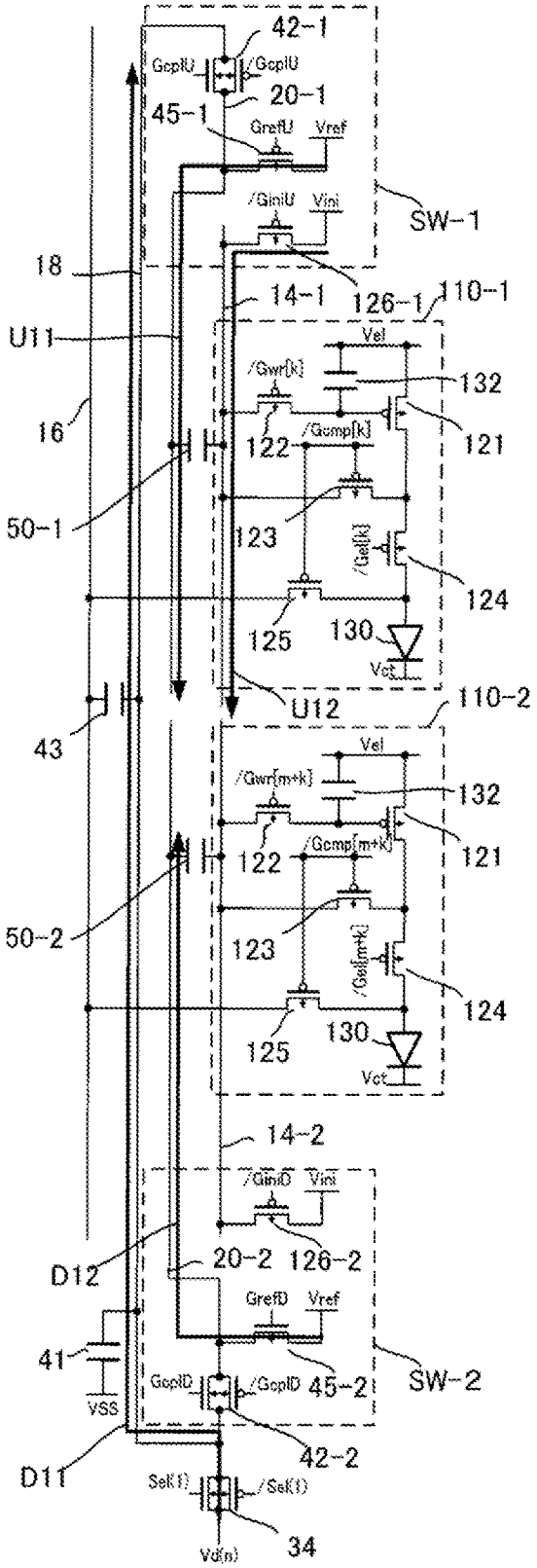
FIG. 7 is a diagram for illustrating an operation of the electro-optical device.

While the control signal /GiniU is the L level, the fifth switch (transistor 126-1) is set in the coupling state, and the potential of the first data line 14-1 is initialized and becomes the initialization potential Vini (FIG. 7: U12). When the scan signal /Gwr(k) and the control signal /Gcmp(k) are shifted to the L level, the transistors 122, 123, and 125 in the first pixel circuit 110-1 are turned ON and shifted from the state illustrated in FIG. 7 to the state illustrated in FIG. 8. In other words, the transistor 124 is turned OFF and the transistors 123 and 125 are turned ON, and thus the gate and the drain of the transistor 121 in the first pixel circuit 110-1 are electrically coupled to the first data line 14-1, and the compensation operation of the transistor 121 (first drive transistor) starts (FIG. 8: U21). Further, the transistor 124 in the first pixel circuit 110-1 is turned OFF and the transistor 125 is turned ON, and thus the anode 130*a* of the OLED 130 (first light emitting element) in the first pixel circuit 110-1 is electrically coupled to the feed line 16, and the potential of the anode 130*a* is initialized and becomes the reset potential Vorst (FIG. 8: U22).

Figure 8:
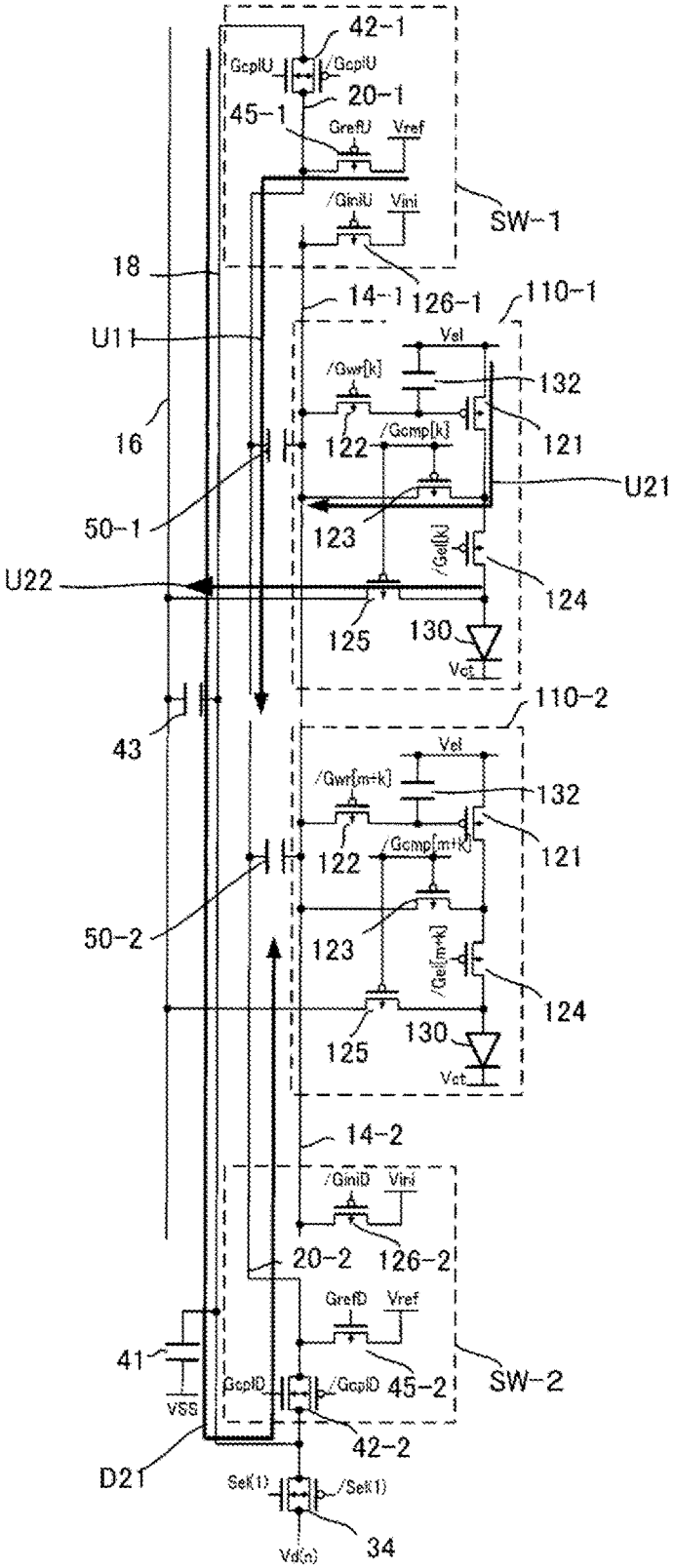
FIG. 8 is a diagram for illustrating an operation of the electro-optical device.

In the first horizontal scan period, the following processing is performed on the pixel circuit 110 (more specifically, the pixel circuit 110 belonging to the (m+k−1)-th row) on which initialization and the compensation operation are performed in a previous horizontal scan period before the first horizontal scan period. The first processing is processing (FIG. 7: D11) of writing a gradation voltage according to a display gradation to the holding capacitor (the capacitor 41 and the inter-wiring capacitor 43) in synchronization with a rising edge of the control signal Sel(1). The second processing is transfer processing (FIG. 8: D21) of bringing the second switch (transmission gate 42-2) into a coupling state, connecting the signal line 18 to the signal line 20-2, and transferring the gradation voltage to the capacitor 50-2, and processing of writing the gradation voltage to the pixel capacitor 132 via the second data line 14-2. FIG. 7 illustrates an example of writing a gradation voltage of the pixel circuit 110 in (m+k−1)-th row and (3n−2)-th column to the holding capacitor in the 3n−2 column. FIG. 8 illustrates an example of transferring the gradation voltage to the capacitor 50-2 in the 3n−2 column. As illustrated in FIG. 7, the potential of the signal line 20-2 is fixed at the reference potential Vref while a gradation voltage is written to the holding capacitor (FIG. 7: D12).

The potential of the first data line 14-1 fluctuates during execution of the compensation operation of the threshold voltage of the transistor 121 in the first pixel circuit 110-1. In the electro-optical device 1 in the exemplary embodiment, the first data line 14-1 is electrically decoupled from the second data line 14-2, and the signal line 20-1, including the capacitor 50-1 between the first data line 14-1, is also electrically decoupled from the signal line 18 in the first horizontal scan period. Thus, while a gradation voltage is written to the pixel capacitor 132 in the pixel circuit 110 in (m+k−1)-th row and (3n−2)-th column, even when the compensation operation of the drive transistor in the first pixel circuit 110-1 in the same column is executed, the potential of the second data line 14-2 does not fluctuate, and the gradation voltage can be accurately written.

When the second horizontal scan period subsequent to the first horizontal scan period starts, the control circuit 3 fixes the control signals /GcplD, /Gel(m+k), and GrefD at the H level. The control circuit 3 also shifts the control signal /GiniD to the L level upon the start of the second horizontal scan period, and brings the control signal /GiniD back to the H level after maintaining the control signal /GiniD at the L level for a certain period of time (see FIG. 9). Then, after the lapse of the certain period of time, the control circuit 3 shifts the scan signal /Gwr(m+k) and the control signal /Gcmp (m+k) to the L level, and maintains the scan signal /Gwr (m+k) and the control signal /Gcmp(m+k) in this state for the second horizontal scan period.

Since the control signal /Gel(m+k) is the H level in the second horizontal scan period, the transistor 124 in each of 3N pixel circuits 110 belonging to the (m+k)-th row is turned OFF, and the OLED 130 (second light emitting element) included in the pixel circuit 110 is set in a non-emission state. Since the control signals /GcplD and GrefD are fixed at the H level during the second horizontal scan period, the transmission gate 42-2 (second switch) is fixed in a decoupling state, and the transistor 45-2 (fourth switch) is fixed in a coupling state. Thus, during the second horizontal scan period, the scan line 20-2 is electrically decoupled from the signal line 18, and the potential of the signal line 20-2 is fixed at the reference potential Vref (FIGS. 9 and 10: D31).

Figure 9:
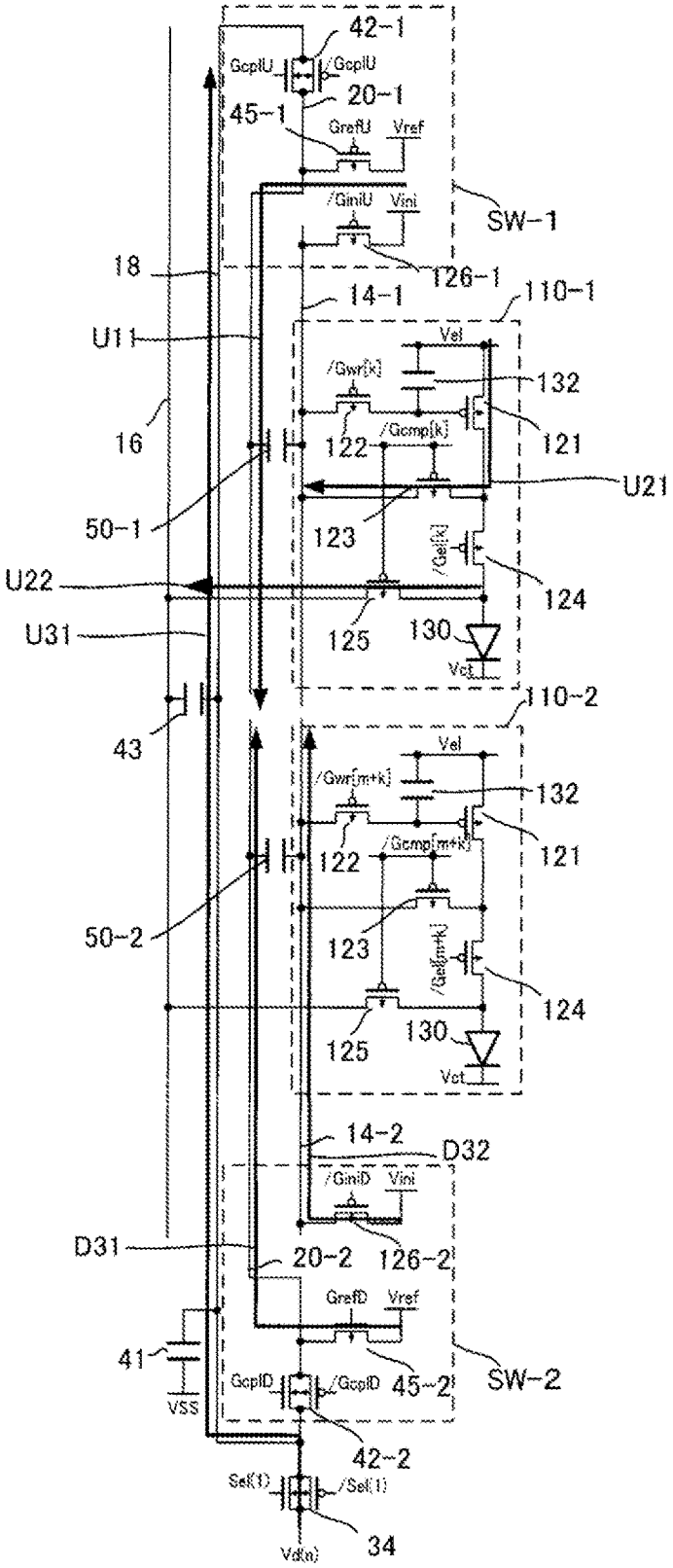
FIG. 9 is a diagram for illustrating an operation of the electro-optical device.
Figure 10:
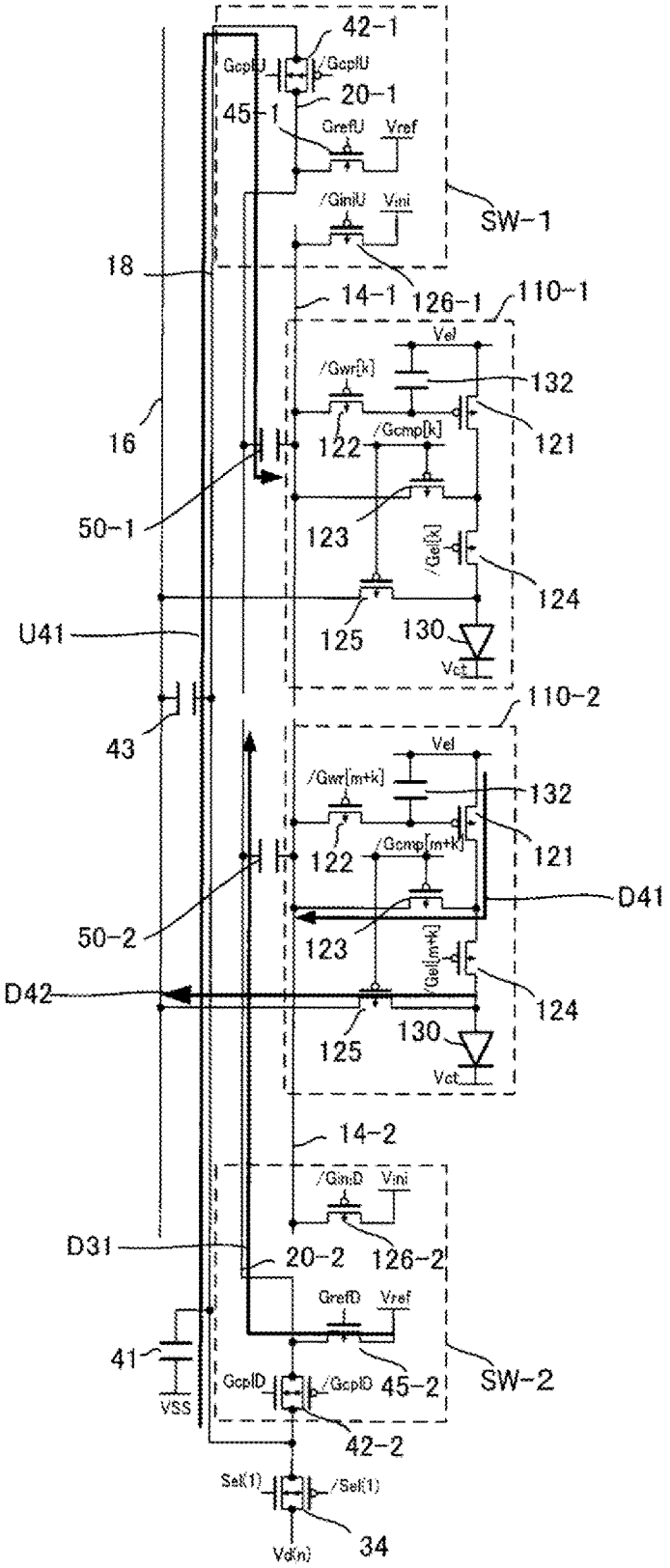
FIG. 10 is a diagram for illustrating an operation of the electro-optical device.

While the control signal /GiniD is the L level, the sixth switch (transistor 126-2) is set in the coupling state, and the potential of the second data line 14-2 is initialized and becomes the initialization potential Vini (FIG. 9: D32). When the scan signal /Gwr(m+k) and the control signal /Gcmp(m+k) are shifted to the L level, the transistors 122, 123, and 125 in the second pixel circuit 110-2 are turned ON and shifted from the state illustrated in FIG. 9 to the state illustrated in FIG. 10. In other words, the transistor 124 is turned OFF and the transistors 123 and 125 are turned ON, and thus the gate and the drain of the transistor 121 in the second pixel circuit 110-2 are electrically coupled to the second data line 14-2, and the compensation operation of the transistor 121 (second drive transistor) starts (FIG. 10: D41). Further, the transistor 124 in the second pixel circuit 110-2 is turned OFF and the transistor 125 is turned ON, and thus the anode 130*a* of the OLED 130 (second light emitting element) in the second pixel circuit 110-2 is electrically coupled to the feed line 16, and the potential of the anode 130*a* is initialized and becomes the reset potential Vorst (FIG. 10: D42).

The control circuit 3 executes the above-described first processing (processing of writing a gradation voltage according to a display gradation to the holding capacitor in the (3n−2)-th column in synchronization with a rising edge of the control signal Sel(1): see U31 in FIG. 9) of the first pixel circuit 110-1 in the second horizontal scan period. Then, after the start of the compensation operation of the second pixel circuit 110-2, as illustrated in FIG. 6, the control circuit 3 shifts the control signal /Gcmp(k) to the H level (shifts the transistor 123 to OFF), and terminates the compensation operation of the drive transistor in the first pixel circuit 110-1. Subsequently, as illustrated in FIG. 6, the control circuit 3 shifts the control signals GcplU and GrefU to the L level (shifts the first switch to the coupling state and the third switch to the decoupling state). After that, as illustrated in FIG. 6, the control circuit 3 shifts the scan signal /Gwr(k) to the H level (shifts the transistor 122 to OFF), and executes the above-described second processing (processing of connecting the signal line 18 to the signal line 20-1 and writing a gradation voltage to the capacitor 50-1: see U41 in FIG. 10). The reason why the transistor 122 is turned OFF after the first switch is shifted to the decoupling state is to avoid an influence of feedthrough noise. Subsequently, as illustrated in FIG. 6, the control circuit 3 brings the control signal GcplU back to the L level after a certain period of time, shifts the first switch to the decoupling state, and also brings the scan signal /Gwr(k) back to the L level and shifts the transistor 122 to the coupling state. The control circuit 3 writes the gradation voltage written to the capacitor 50-1 to the pixel capacitor 132 in the first pixel circuit 110-1, and then shifts the scan signal /Gwr(k) to the H level again. While the gradation voltage is written to the pixel capacitor 132 in the first pixel circuit 110-1, even when the compensation operation of the drive transistor in the second pixel circuit 110-2 in the same column is executed, the potential of the first data line 14-1 does not fluctuate, and the gradation voltage can be accurately written as described above.

According to the exemplary embodiment as described above, the compensation operation can be performed on the pixel circuit 110 belonging to the lower pixel block while a gradation voltage is written to the pixel circuit 110 belonging to the upper pixel block, and the compensation operation can be performed on the pixel circuit 110 belonging to the upper pixel block while a gradation voltage is written to the pixel circuit 110 belonging to the lower pixel block. Thus, in the electro-optical device 1 in the exemplary embodiment, while a gradation voltage is written to the pixel circuit 110 belonging to the pixel block that is one of the upper pixel block and the lower pixel block, the compensation operation performed on the pixel circuit 110 belonging to the other pixel block and the same column can start in advance, which results in a sufficiently longer compensation period.

This aspect is applicable to fine pixels because the holding capacitor does not need to be provided in the pixel circuit. The source of the drive transistor does not need to float during the compensation operation of the drive transistor included in the pixel circuit, and thus threshold voltage compensation can be accurately performed.

The pixel circuit 110 of the electro-optical device 1 in the exemplary embodiment does not include a capacitor that holds a threshold voltage of the transistor 121 separately from the pixel capacitor 132. Thus, the electro-optical device 1 and a method of driving the electro-optical device 1 in the exemplary embodiment are compatible with fine pixels. Note that, in the electro-optical device 1 in the exemplary embodiment, a gradation voltage supplied to the first data line 14-1 in the n-th column and a gradation voltage supplied to the second data line 14-2 in the n-th column are generated by one amplifier. The reason for this is as follows. When an amplifier (hereinafter an upper amplifier) that generates a gradation voltage supplied to the first data line 14-1 is different from an amplifier (hereinafter a lower amplifier) that generates a gradation voltage supplied to the second data line 14-2 in the n-th column, a malfunction occurs that a boundary between the upper pixel block and the lower pixel block is clearly visually recognized due to a difference in characteristic of both of the amplifiers, a difference in arrangement position, and the like. In order to avoid such a malfunction, in the electro-optical device 1 in the exemplary embodiment, a gradation voltage supplied to the first data line 14-1 in the n-th column and a gradation voltage supplied to the second data line 14-2 in the n-th column are generated by one amplifier.

B. Modification Example

Although one exemplary embodiment of the invention has been described above, the following modification examples may be added to this exemplary embodiment.

(1) In the above-described exemplary embodiment, the capacitor 41 and the inter-wiring capacitor 43 function as a holding capacitor that holds an electric charge according to the data signal Vd(n). However, the capacitor 41 may be eliminated, and only the inter-wiring capacitor 43 may function as a holding capacitor. According to this aspect, a circuit area of a portion other than the display region of the display unit 100 can be reduced by the capacitor 41.

(2) Although the aspect (see FIG. 3) where the pixel circuit 110 belonging to the upper pixel block and the pixel circuit 110 belonging to the lower pixel block are alternately selected in order from the top by each row in the above-described exemplary embodiment, an aspect may be adopted where they are alternately selected in order from the bottom by each row. An aspect may also be adopted where the pixel circuit 110 is selected in order from the bottom by each row in the upper pixel block and the pixel circuit 110 is selected in order from the top by each row in the lower pixel block. Alternatively, an aspect may also be adopted where the pixel circuit 110 is selected in order from the top by each row in the upper pixel block and the pixel circuit 110 is selected in order from the bottom by each row in the lower pixel block.

C. Application Example

The electro-optical device according to the exemplary embodiment described above can be applied to various electronic apparatuses, and is particularly suitable for an electronic apparatus that is required to display a high-definition image of 2K 2K or higher and is required to be compact. Hereinafter, an electronic apparatus according to the invention will be described.

Figure 11:
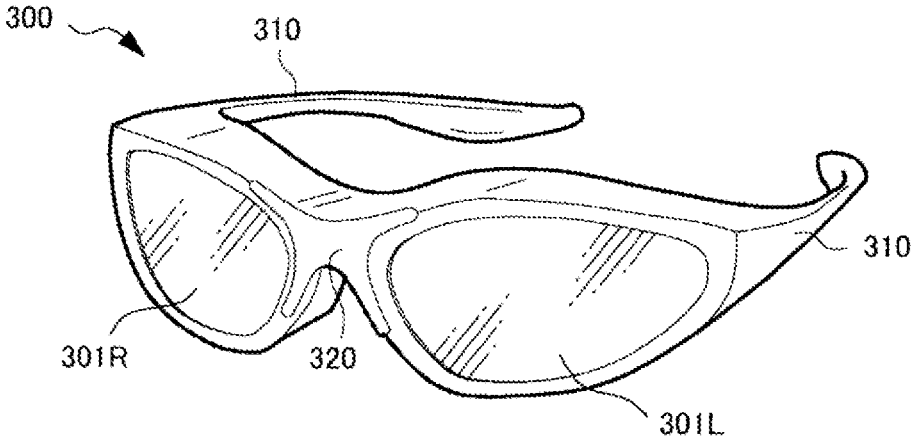
FIG. 11 is a perspective view of a head-mounted display 300 according to the invention.

FIG. 11 is a perspective view illustrating an outer appearance of a head-mounted display 300 as an electronic apparatus employing the electro-optical device 1 of the invention. As illustrated in FIG. 11, the head-mounted display 300 includes a temple 310, a bridge 320, a projection optical system 301L, and a projection optical system 301R. And, in FIG. 11, an electro-optical device (not illustrated) for the left eye is provided behind the projection optical system 301L, and an electro-optical device (not illustrated) for the right eye is provided behind the projection optical system 301R.

Figure 12:
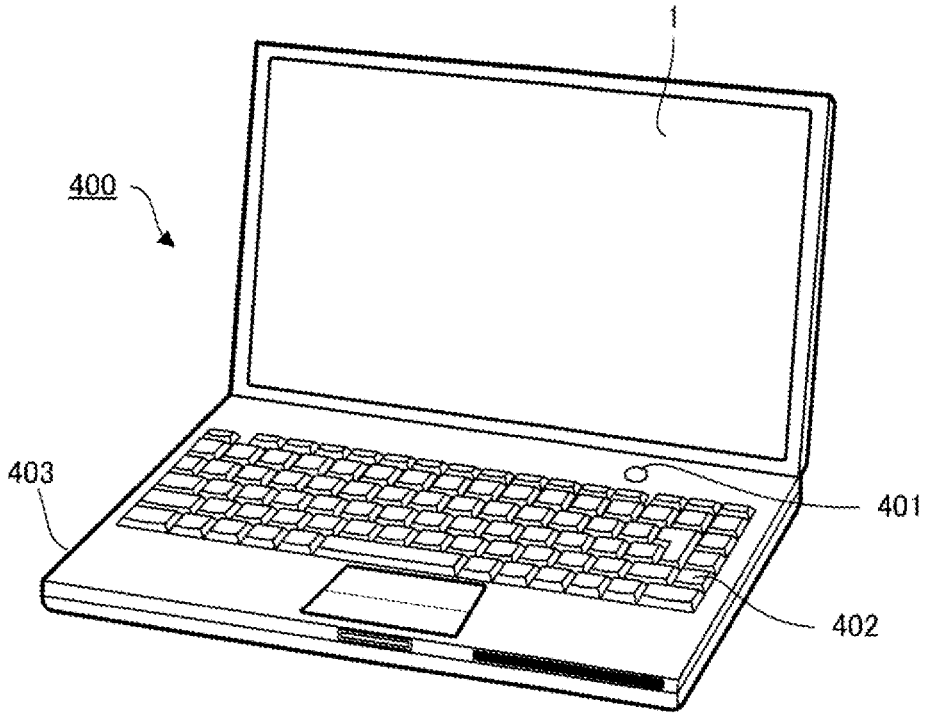
FIG. 12 is a perspective view of a personal computer 400 according to the invention.

FIG. 12 is a perspective view of a portable personal computer 400 adopting the electro-optical device 1 according to the invention. The personal computer 400 includes an electro-optical device 1 that displays various images, and a main body portion 403 provided with a power switch 401 and a keyboard 402. Note that, examples of the electronic apparatus to which the electro-optical device 1 according to the invention is applied, in addition to the apparatus illustrated in FIGS. 11 and 12, include an electronic device arranged close to the eyes such as a digital scope, a digital binocular, a digital still camera, and a video camera. Furthermore, the invention can also be applied as a display unit provided in an electronic apparatus such as a mobile phone, a smartphone, a personal digital assistant (PDA), a car navigation device, and an onboard indicator (instrument panel).

The entire disclosure of Japanese Patent Application No. 2018-042610, filed Mar. 9, 2018 is expressly incorporated by reference herein.

What is claimed is:

1. An electro-optical device comprising:

a first wiring line extending in a first direction in a display region, the first wiring line being supplied with a gradation voltage from a data signal supply circuit;

a first data line and a second data line extending in the first direction in the display region;

a first pixel circuit coupled to the first data line;

a second pixel circuit coupled to the second data line;

a first switch having a first end coupled to the first wiring line receiving the gradation voltage from the first wiring line and a second end coupled to the first data line;

a second switch having a first end coupled to the first wiring line receiving the gradation voltage from the first wiring line and a second end coupled to the second data line, wherein the first switch is fixed in a decoupling state during a first horizontal scan period and the second switch is fixed in a decoupling state during a second horizontal scan period subsequent to the first horizontal scan period.

2. The electro-optical device according to claim 1, wherein the first wiring line is aligned beside the first data line and the second data line, the first data line and the second data line being divided data lines in the first direction.

3. The electro-optical device according to claim 1, further comprising a second wiring aligned beside the first wiring line and provided with a fixed potential, the first wiring and the second wiring form a holding capacitor.

4. The electro-optical device according to claim 1, wherein the display area is sandwiched between the first switch and the second switch in the first direction.

5. The electro-optical device according to claim 1, further comprising:

a first capacitor including one electrode coupled to the first data line and the other electrode coupled to the first pixel circuit; and a second capacitor including one electrode coupled to the second data line and the other electrode coupled to the second pixel circuit.

6. The electro-optical device according to claim 1, wherein the display area is sandwiched between the first switch and the data signal supply circuit.

7. An electro-optical device comprising:

a first data line and a second data line being divided data lines;

a first pixel circuit coupled to the first data line;

a second pixel circuit coupled to the second data line;

a first capacitor including one electrode coupled to the first data line and the other electrode;

a second capacitor including one electrode coupled to the second data line and the other electrode;

a first wiring provided with a holding capacitor supplied with a gradation voltage according to a display gradation of the first pixel circuit or a display gradation of the second pixel circuit from a data signal supply circuit;

a first switch provided between the other electrode of the first capacitor and the first wiring and configured to be controlled to be in a coupling state or a decoupling state; and a second switch provided between the other electrode of the second capacitor and the first wiring and configured to be controlled to be in a coupling state or a decoupling state, wherein the first pixel circuit includes a first light emitting element, a first drive transistor configured to control a current flowing through the first light emitting element according to a gradation voltage provided from the first data line, and a first compensation circuit, the second pixel circuit includes a second light emitting element, a second drive transistor configured to control a current flowing through the second light emitting element according to a gradation voltage provided from the second data line, and a second compensation circuit, and the electro-optical device further comprising: a third switch provided between a reference power source and the other electrode of the first capacitor and configured to be controlled to be in a coupling state or a decoupling state, the reference power source being configured to generate a reference potential used in a compensation operation for compensating a threshold voltage of the first drive transistor;

a fourth switch provided between the reference power source and the other electrode of the second capacitor and configured to be controlled to be in a coupling state or a decoupling state;

a fifth switch provided between an initialization power source and the first data line and configured to be controlled to be in a coupling state or a decoupling state, the initialization power source being configured to generate an initialization potential for initializing the first drive transistor or the second drive transistor; and a sixth switch provided between the second data line and the initialization power source and configured to be controlled to be in a coupling state or a decoupling state.

8. The electro-optical device according to claim 7, wherein the first wiring is aligned beside the first data line and the second data line, the electro-optical device includes a second wiring coupled to the first switch and the third switch and aligned beside the first data line, a third wiring coupled to the second switch and the fourth switch and aligned beside the second data line, and a fourth wiring aligned beside the first wiring and provided with a fixed potential, the first data line and the second wiring form the first capacitor, the second data line and the third wiring form the second capacitor, and the first wiring and the fourth wiring form the holding capacitor.

9. A method of driving the electro-optical device according to claim 7, comprising:

fixing the first switch in a decoupling state, fixing the third switch in a coupling state, setting the fifth switch in a coupling state, performing initialization on the first drive transistor, then bringing the fifth switch back to a decoupling state, and starting a compensation operation of the first drive transistor in a first horizontal scan period; and fixing the second switch in a decoupling state, setting the sixth switch in a coupling state, performing initialization on the second drive transistor, then bringing the sixth switch back to a decoupling state, fixing the fourth switch in a coupling state, starting a compensation operation of the second drive transistor, causing the holding capacitor to hold a gradation voltage according to a display gradation of the first pixel circuit after the start of the compensation operation of the second drive transistor, then setting the third switch in a decoupling state and the first switch in a coupling state, and writing a voltage according to the gradation voltage to the first capacitor in a second horizontal scan period subsequent to the first horizontal scan period.

10. An electronic apparatus comprising:

the electro-optical device according to claim 1.

11. An electronic apparatus comprising:

the electro-optical device according to claim 7.

* * * * *